US010827244B1

(12) United States Patent
Ward et al.

(10) Patent No.: US 10,827,244 B1
(45) Date of Patent: Nov. 3, 2020

(54) BREATHING TUBE ADAPTER FOR A RESPIRATOR WITH AN INTERNAL SPEAKER

(71) Applicant: E.D. Bullard Company, Cynthiana, KY (US)

(72) Inventors: David Amos Ward, Lexington, KY (US); Edward Charles Apley, II, Lexington, KY (US)

(73) Assignee: E.D. Bullard Company, Cynthiana, KY (US)

( * ) Notice: Subject to any disclaimer, the term of this patent is extended or adjusted under 35 U.S.C. 154(b) by 0 days.

(21) Appl. No.: 16/599,251

(22) Filed: Oct. 11, 2019

Related U.S. Application Data

(60) Provisional application No. 62/744,861, filed on Oct. 12, 2018.

(51) Int. Cl.
*H04R 1/02* (2006.01)
*A62B 9/00* (2006.01)
*A62B 9/04* (2006.01)

(52) U.S. Cl.
CPC ..... *H04R 1/028* (2013.01); *A62B 9/006* (2013.01); *A62B 9/04* (2013.01); *H04R 1/025* (2013.01)

(58) Field of Classification Search
CPC ..... A62B 9/04; A62B 9/006; H04R 1/028; H04R 1/025
See application file for complete search history.

(56) References Cited

U.S. PATENT DOCUMENTS

2012/0138051 A1* 6/2012 Curran ..... F04D 27/004 128/201.25
2014/0332005 A1* 11/2014 Kunz ..... A61M 16/0825 128/205.25
2017/0001048 A1* 1/2017 Volmer ..... F04D 25/0673
2019/0126077 A1* 5/2019 Kilmer ..... F04D 27/004

* cited by examiner

*Primary Examiner* — Regina N Holder

(74) *Attorney, Agent, or Firm* — Stites & Harbison, PLLC; David W. Nagle, Jr.; Gary N. Stewart

(57) ABSTRACT

An adapter for connecting a breathing tube to a headpiece includes: a housing including a first portion configured to connect to a breathing tube, a second portion configured to connect to a headpiece, and a hollow cavity extending through the first portion and the second portion to define a flow path for breathable air received from the breathing tube to travel through the adapter for delivery to the headpiece; and a speaker configured to emit an audible sound into the flow path. The speaker is positioned within the housing so that, when the adapter is connected to a breathing tube and a headpiece of a respirator system, the speaker is in close proximity to the headpiece to help ensure sound emitted from the speaker is audible to a user wearing the headpiece. The speaker is also positioned outside of the flow path to prevent air flow obstruction within the adapter.

18 Claims, 5 Drawing Sheets

BREATHING TUBE ADAPTER FOR A RESPIRATOR WITH AN INTERNAL SPEAKER

CROSS-REFERENCE TO RELATED APPLICATIONS

The present application claims priority to U.S. Patent Application Ser. No. 62/744,861 filed on Oct. 12, 2018, the entire disclosure of which is incorporated herein by reference.

BACKGROUND OF THE INVENTION

The present invention relates to respirators which accept pressurized air from a supply source and convert it to breathable air, which is delivered to a headpiece worn by a user, such as a hood or mask, via a breathing tube.

During use of a respirator system, it is important for users to be notified if the air flow being supplied by the respirator is either too low or too high in order to avoid potential injury. For example, during normal operation of a respirator, breathable air should be supplied at between approximately 7 and 12 cubic feet per minute (CFM); if it is outside of this range, the user should typically be notified. In prior art constructions, this is commonly done via an audible alarm. Generally, it is preferred that such alarm be above 90 decibels (dB). Such an alarm can, however, impede air flow delivery or efficacy depending on its orientation within the system. Further, it is often preferred to maintain the ambient sound level of the air produced by the respirator below a certain audible threshold. Thus, noise suppression techniques may be implemented within a respirator system and used to reduce the ambient noise level within the system. However, in addition to suppressing ambient noise, these noise suppression techniques can also reduce or negate the sound level of desired audible sound.

SUMMARY OF THE INVENTION

The present invention is an adapter configured to interconnect the breathing tube and headpiece of a respirator system and to transmit an audible sound to a user.

An exemplary adapter made in accordance with the present disclosure includes: a housing having a first portion configured to connect to a breathing tube, a second portion configured to connect to a headpiece, and a hollow cavity extending through the first portion and the second portion to define a flow path for guiding breathable air received from a breathing tube to a headpiece; and a speaker configured to emit audible sound into the flow path. The speaker is positioned within the housing of the adapter, such that when the adapter is connected to the breathing tube and headpiece of a respirator system, the speaker is in close proximity to the headpiece to help ensure sound emitted from the speaker is audible to a user wearing the headpiece, even if noise suppression techniques are employed within the respirator system.

In some embodiments, the flow path of the adapter is defined by a first internal channel within the first portion of the housing and a second internal channel defined by the second portion of the housing. The first internal channel includes an inlet for receiving air transmitted from a breathing tube into the adapter and the second internal channel includes an outlet for emitting air from the adapter into a headpiece of a respirator system. The first portion and the second may be oriented at an angle with respect to one another causing the flow path to be a non-linear pathway between the inlet and outlet. When the adapter is implemented within a respirator system, the angled orientation between the housing's first portion and second portion may serve to reduce or limit the extent to which the system's breathing tube must bend to establish an air flow connection with the adapter connected to the system's headpiece. Such angled orientation also serves to hold the breathing tube proximate to a user's body, thereby reducing the risk of the breathing tube becoming caught on, and subsequently disconnected by, an object within the user's environment To prevent the speaker from obstructing or preventing the flow of air through the flow path, the speaker is preferably positioned within the housing at a location that is outside the flow path. To this end, the speaker may be positioned within, and the housing may further include, a secondary chamber positioned outside of the flow path. In some embodiments, the housing may further includes an internal wall, which serves to separate the secondary chamber from the flow path. The internal wall may define a port that provides a passageway between the secondary chamber and the flow path through which sound emitted from the speaker may travel. The speaker, chamber, and port may each be positioned opposite of the outlet of the adapter to provide a direct pathway along which sound emitted from the speaker may travel from an interior of the adapter to an exterior of the adapter.

In some embodiments, the speaker is configured to emit sound based on an activation signal received from a device, such as a microprocessor, positioned outside of the adapter and to which the speaker is operably connected. The speaker may be operably connected to such an external device by way of a wired or wireless connection. In the case of the former, the speaker may include one or more electrical wires that extend into the first portion of the housing to facilitate electrical connection between the speaker and the device. To permit passage of the one or more electrical wires from the speaker to an interior of the first portion, the housing may further include a third channel that extends from the secondary chamber to the first internal channel defined by the housing's first portion.

DETAILED DESCRIPTION OF THE INVENTION

The present invention is an adapter configured to interconnect the breathing tube and headpiece of a respirator system and to transmit an audible sound to a user.

Figure 1:
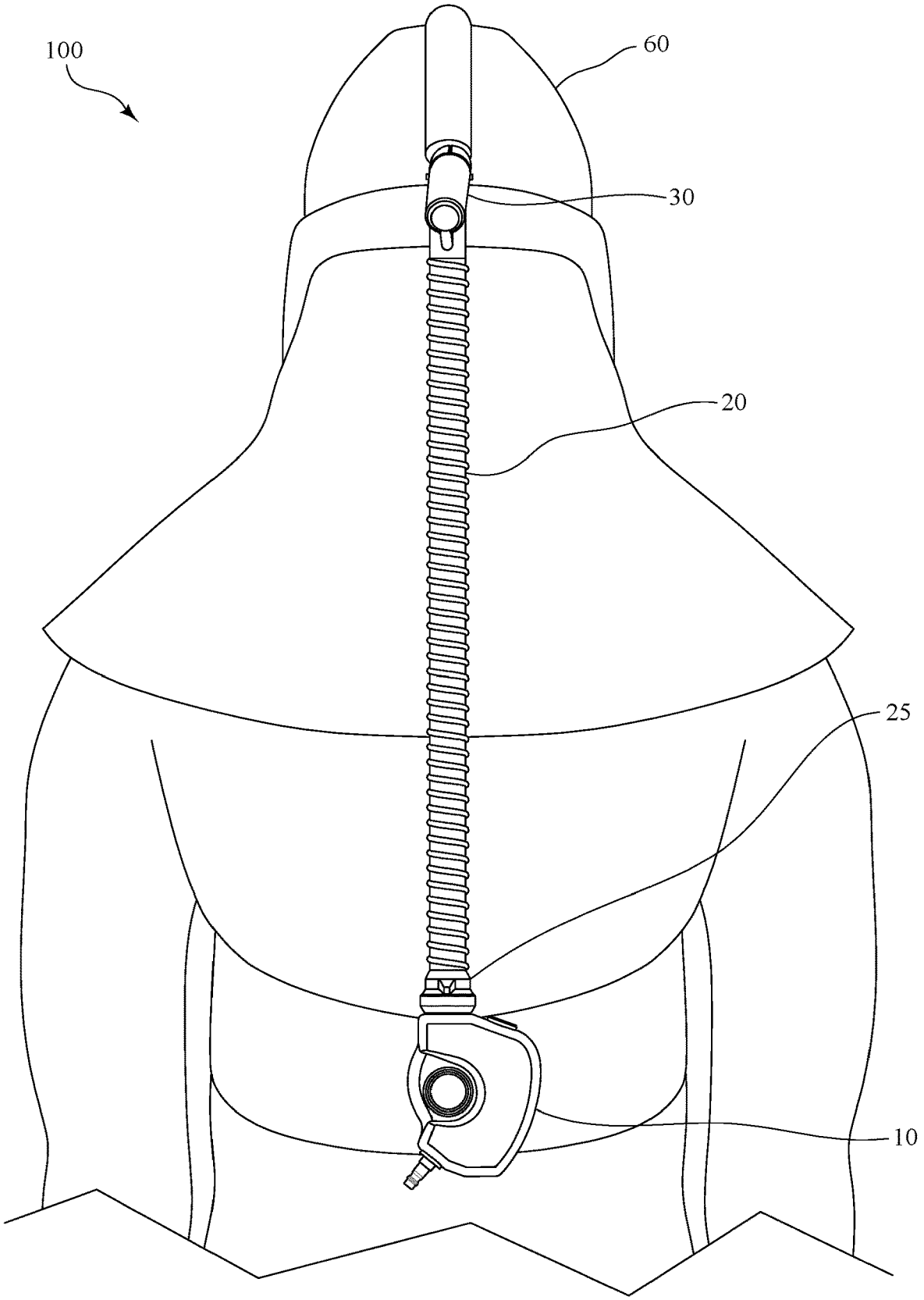
FIG. 1 is a front view of a user wearing a respirator system (on the back of the user) including an exemplary adapter made in accordance with the present invention.
Figure 2:
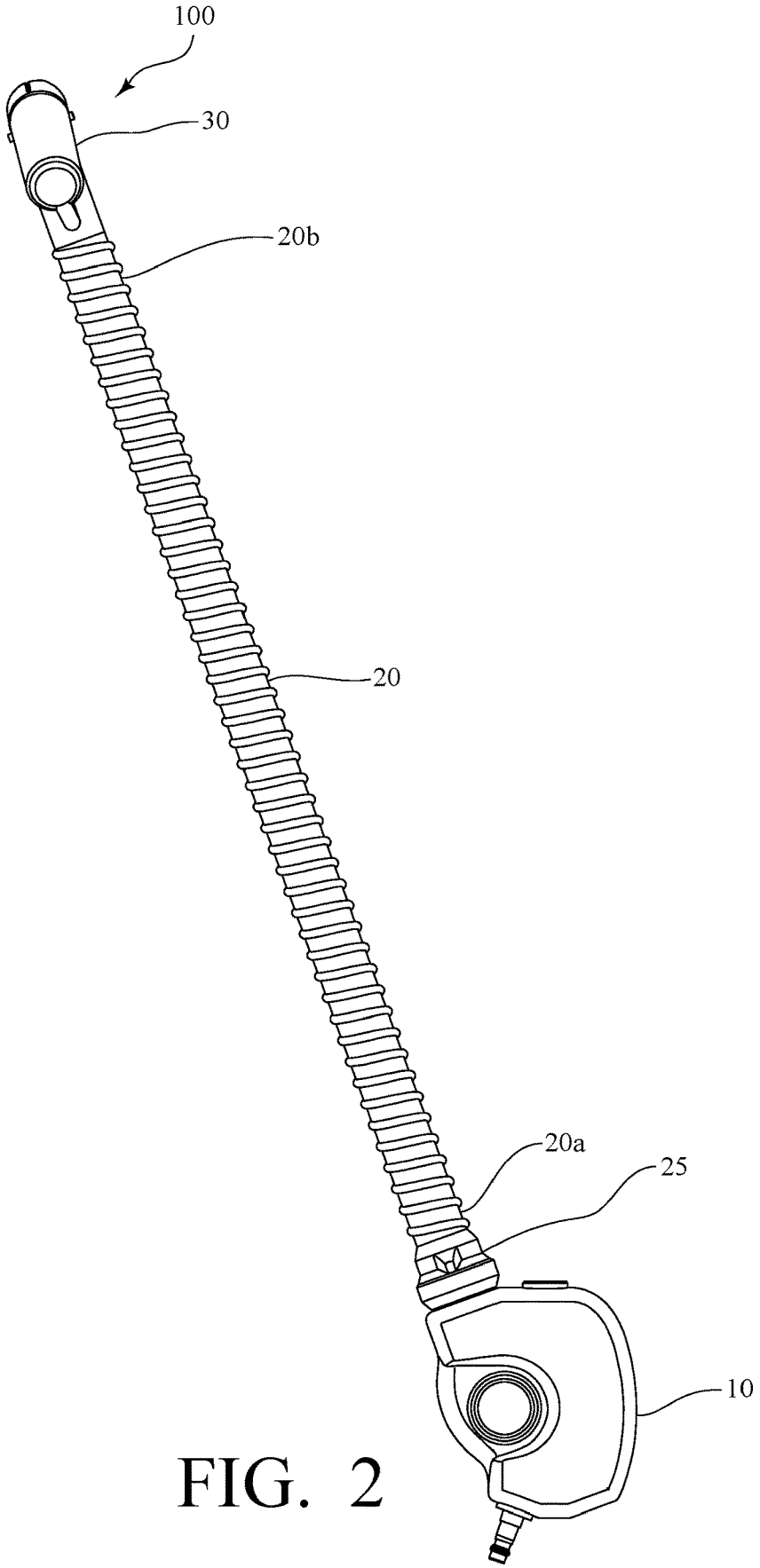
FIG. 2 is a front view of the respirator system of FIG. 1.

FIG. 1 is a front view of a user wearing a respirator system 100 (on the back of the user) including an exemplary adapter 30 made in accordance with the present invention. FIG. 2 is a front view of the respirator system 100 of FIG. 1, expect for the headpiece 60. As shown in FIGS. 1 and 2, the respirator system 100 includes: a respirator 10; a breathing tube 20; a quick connect assembly 25 for connecting the breathing tube 20 to the respirator 10; the exemplary adapter 30; and a headpiece 60. The respirator 10 is configured to accept pressurized air from a supply source and convert it to breathable air. The breathing tube 20 is configured to transport breathable air generated by the respirator 10 to the adapter 30, and thus may be any conduit suitable for doing the same. The breathing tube 20 has a proximal end 20*a* connected to one or more components of the quick connect assembly 25 and a distal end 20*b* connected to the adapter 30. In other embodiments, the breathing tube 20 may be directly connected to the respirator 10.

Referring still to FIGS. 1 and 2, the adapter 30 is connected to the breathing tube 20 and the headpiece 60 and defines a flow path, as further described below, which directs air received by the breathing tube 20 to the headpiece 60. The headpiece 60 defines an interior volume to which breathable air generated within the respirator system 100 is delivered for consumption by a user wearing the headpiece 60. The headpiece 60 of the respirator system 100 shown in FIG. 1 is a hood which covers a user's head when worn. However, the headpiece 60 may alternatively comprise a mask or another article designed to be worn on an individual's head and deliver breathable air.

Figure 3:
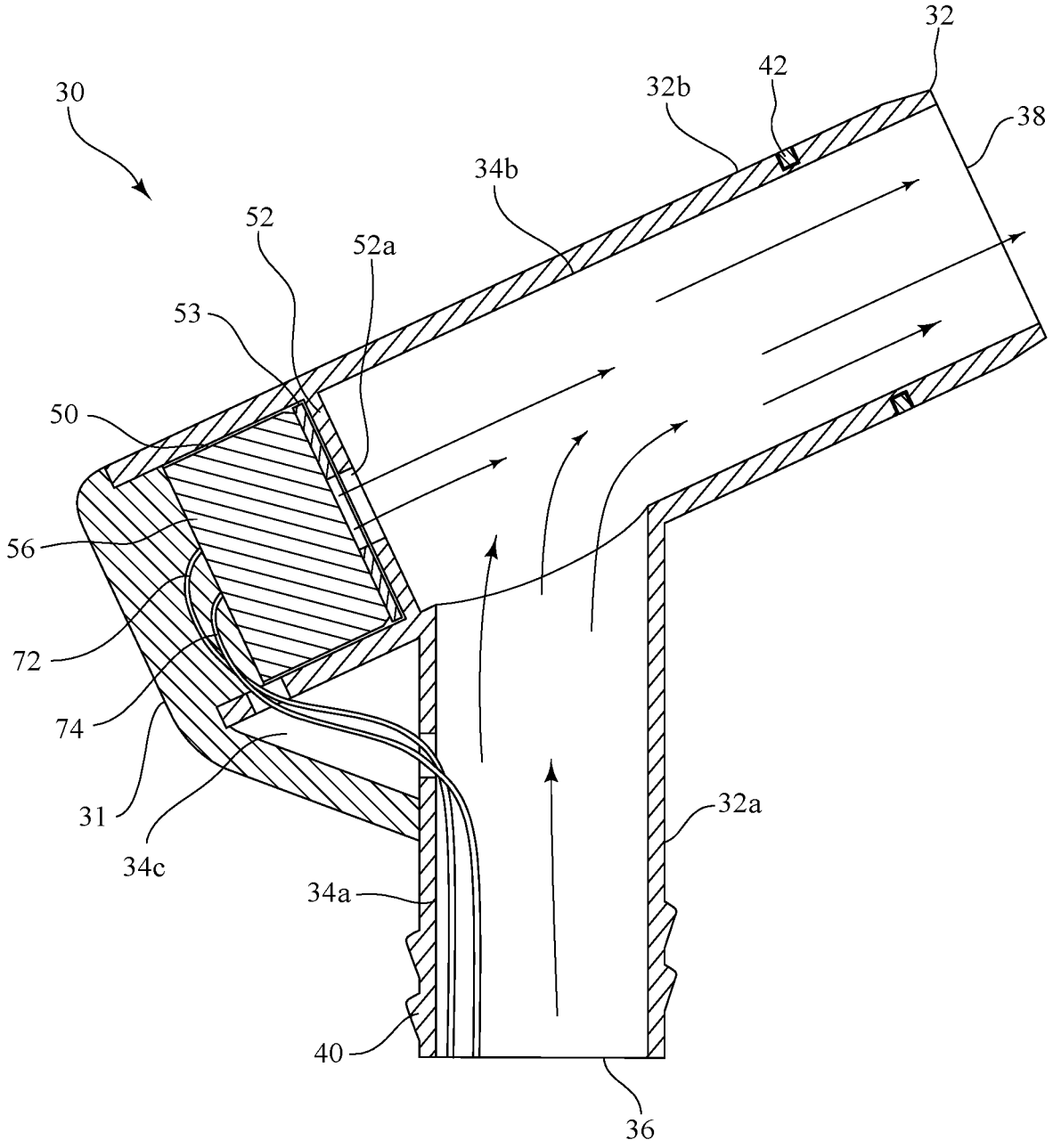
FIG. 3 is a side sectional view of the exemplary adapter of FIG. 1.

FIG. 3 is a side sectional view of the exemplary adapter 30. As shown in FIG. 3, the adapter 30 includes: a housing 32 having an internal cavity that defines a flow path along which breathable air is directed through the adapter 30; and a speaker 56 positioned within the housing 32 that is configured to emit audible sound into the flow path. The housing 32 defines and can be characterized as including: a first portion 32*a* that is configured to connect to the breathing tube 20; and a second portion 32*b* that is configured to connect to the headpiece 60. In this regard, as shown in FIG. 3, the first portion 32*a* includes a first securing element 40, and the second portion 32*b* includes a second securing element 42. In the exemplary embodiment, the first securing element 40 is male threading configured to interlock with the female threading (not shown) of a breathing tube 20, and the second securing element 42 is a ring adapted to interlock with an interlock mechanism of the intake port (not shown) of a headpiece 60. It should be recognized, however, that the first portion 32*a* and second portion 32*b* of the housing 32 can include alternative securing elements or be designed in any way suitable that provides a substantially airtight connection to the breathing tube 20 and headpiece 60, respectively, while still enabling the adapter 30 to function for its intended purpose.

Referring still to FIG. 3, the first portion 32*a* of the housing 32 defines a first internal channel 34*a* within the interior of the housing 32, which forms a first portion of the overall flow path of the adapter 30. To receive breathable air emitted from a breathing tube 20, the first portion 32*a* of the housing 32 includes an inlet 36. Similarly, the second portion 32*b* of the housing 32 defines a second internal channel 34*b* within the interior of the housing 32, which forms a second portion of the overall flow path of the adapter 30 and includes an outlet 38 for emitting breathable air from the adapter 30. The first internal channel 34*a* and the second internal channel 34*b* intersect with each other to collectively define a flow path that extends from the inlet 36 to the outlet 38.

Referring still to FIG. 3, the first portion 32*a* of the housing 32 and the second portion 32*b* of the housing 32 are not aligned, but rather are oriented at an angle with respect to one another. In turn, the first internal channel 34*a* defined by the first portion 32*a* and the second internal channel 34*b* defined by the second portion 32*b* are also oriented at an angle with respect to one another, such that the inlet 36 and the outlet 38 are not positioned in parallel, thereby causing the flow path collectively defined by the first internal channel 34*a* and the second internal channel 34*b* to be non-linear. Thus, as shown in FIG. 3, as breathable air enters the adapter 30 through the inlet 36, it passes through the first internal channel 34*a* and is deflected into the second internal channel 34*b* from which it is subsequently emitted from the adapter 30 through the outlet 38. When the adapter 30 is implemented within a respirator system 100, the angled orientation between the first portion 32*a* and second portion 32*b* of the housing 32 serves to reduce the extent to which the breathing tube 20 of the respirator system 100 must be bent or otherwise manipulated to establish an air flow connection between the respirator 10 and the adapter 30, as best shown in FIG. 1. The angled relation between the first portion 32*a* and the second portion 32*b* of the housing 32 may also serve to hold the breathing tube 20 proximate to a user's body when the respirator system 100 is in use, thereby reducing the risk of the breathing tube 20 becoming caught on, and subsequently disconnected by, an object within the user's environment.

Figure 4:
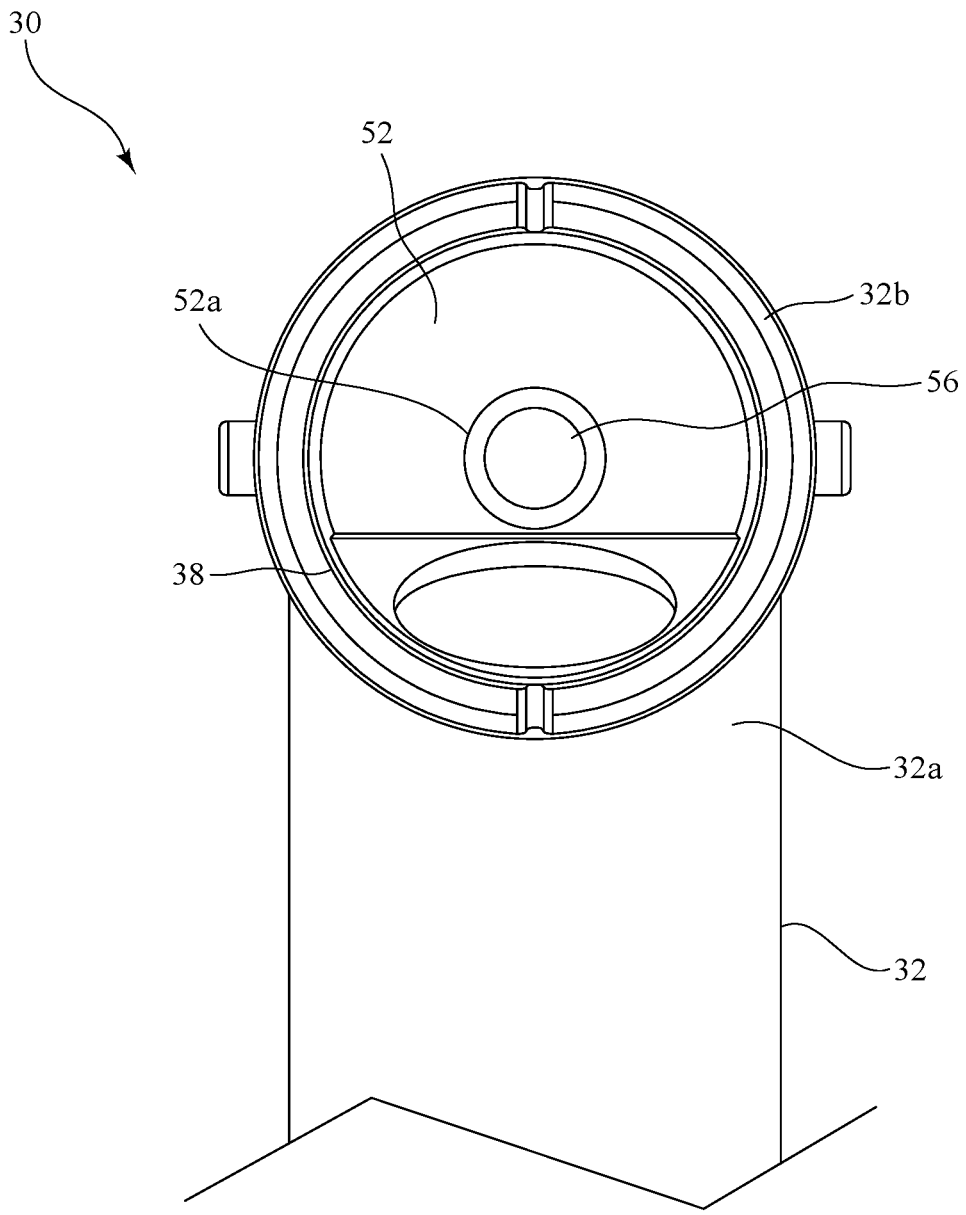
FIG. 4 is a partial rear view of the exemplary adapter of FIG. 1.

Referring still to FIG. 3, along with the partial rear view of FIG. 4, the speaker 56 is positioned within the housing 32 outside of the flow path defined by the first internal channel 34*a* and the second internal channel 34*b* to prevent the speaker 56 from obstructing the flow of air through the adapter 30. Specifically, the housing 32 further defines a secondary chamber 50 which is positioned outside of the flow path, and the speaker 56 is positioned in the secondary chamber 50. In the exemplary embodiment, the secondary chamber 50 is defined by the second portion 32*b* of the housing 32 and is positioned behind the second internal channel 34*b* defined by the second portion 32*b* of the housing 32.

Referring still to FIGS. 3 and 4, in this exemplary embodiment, in order to separate the speaker 56 from the flow path, the housing 32 further includes an internal wall 52 that establishes a physical barrier between the secondary chamber 50 and the second internal channel 34*b*. As best shown in FIG. 4, the internal wall 52 defines a port 52*a* extending from the secondary chamber 50 to the second internal channel 34*b*. Thus, the port 52*a* establishes a passageway between the secondary chamber 50 and the second internal channel 34*b* through which sound emitted from the speaker 56 is directed into the flow path. To maintain spacing between the speaker 56 and the internal wall 52, a gasket 53 is positioned between the speaker 56 and the internal wall 52. The gasket 53 includes a central opening, which is aligned with the port 52*a*, to permit sound emitted from the speaker 56 to travel through the gasket 53. As also shown in FIGS. 3 and 4, the secondary chamber 50, the port 52*a*, and the speaker 56 are each positioned opposite of the outlet 38 to provide a direct pathway along which sound emitted from the speaker 56 may travel through the interior of the adapter 30 before being emitted from the outlet 38. The direct pathway established by such arrangement may serve to reduce the extent to which sound emitted from the speaker 56 is deflected or degraded before reaching a user. Further, as a result of such arrangement, noise suppression techniques employed within the respirator 10, the breathing tube 20, the quick connect assembly 25, or even the first portion 32*a* of the adapter's 30 housing 32 will not impede the transmission of sound emitted from the speaker 56 out of the adapter 30. Moreover, when the adapter 30 is utilized to interconnect a breathing tube 20 and a headpiece 60 of a respirator system 100, the inclusion and positioning of the speaker 56 within the housing 32 results in the speaker 56 being positioned in close proximity to the headpiece 60 of the respirator system 100, thereby further ensuring audible sound emitted from the speaker 56 is heard by a user wearing the headpiece 60.

Referring again to FIG. 3, in this exemplary embodiment, the secondary chamber 50 is sealed with a potting material 31, such as a low-pressure overmolding, which protects the speaker 56 and any associated wires 72, 74, while also forming the outer decorative surface of adapter 30 located behind the speaker 56.

Figure 5:
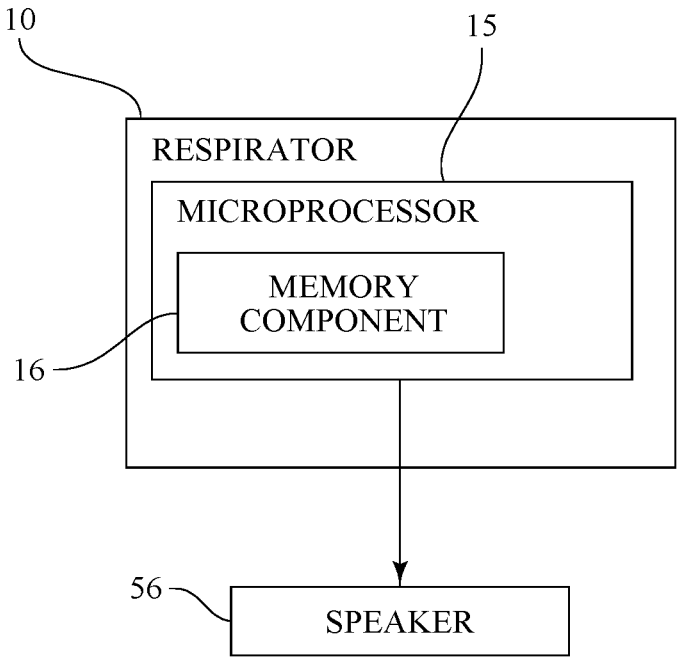
FIG. 5 is a block diagram showing the internal speaker of the exemplary adapter of FIG. 1 operably connected to a microprocessor within the respirator of the respirator system of FIG. 1.

FIG. 5 is a block diagram showing the speaker 56 operably connected to a device positioned outside of the adapter 30. In this exemplary embodiment, the speaker 56 is configured to emit audible sound based upon an activation signal received from an electronic device positioned outside of the adapter 30. More specifically, in this exemplary embodiment, the speaker 56 is operably connected to a microprocessor 15 associated with the respirator 10 of the respirator system 100. The microprocessor 15 is operably connected to a memory component 16 having programming instructions stored thereon, which, when executed by the microprocessor 15, cause the microprocessor 15 to perform the various operations disclosed herein. The microprocessor 15 is configured to generate and transmit an activation signal, which, when received by the speaker 56, causes the speaker 56 to emit an audible sound. For example, the respirator 10 may, in some embodiments, include pressure sensors (not shown), which are operably connected to the microprocessor 15 and are configured to measure air pressure within the respirator system 100. In such embodiments, the microprocessor 15 may process readings from the pressure sensors to determine whether air flow within the respirator system 100 is too low or too high and transmit an activation signal, which, when received by the speaker 56, causes the speaker 56 to emit an audible sound alerting the user that the respirator system 100 is generating either too much or too little air flow.

It should also be recognized, however, that the microprocessor 15 and speaker 56 may be used to communicate verbal cues, verbal instructions, or other audible sounds which do not relate to air flow within the respirator system 100. Indeed, the respirator system 100 may further include, and the speaker 56 and microprocessor 15 may be used in combination with, a microphone (not shown) to provide a two-way communication system. It should also be recognized that the microprocessor 15 associated with the respirator 10 of the respirator system represents but one exemplary electronic device to which the speaker 56 of the adapter 30 maybe operably connected. Accordingly, in other embodiments, the speaker 56 may be operably connected to other electronic devices, either within the respirator system 100 or outside of the respirator system 100, which are adapted to communicate with the speaker 56 via the microprocessor 15 and cause it to emit audible sound.

Communication of the activation signal from an electronic device to the speaker 56 may be facilitated by a wired or wireless connection. Referring again to FIG. 3, in this exemplary embodiment, the speaker 56 includes two electrical wires 72, 74 for operably connecting the speaker 56 to an electronic device, such as the microprocessor 15, or to corresponding electrical contacts of the electronic device. As further shown in FIG. 3, the electrical wires 72, 74 extend into the first internal channel 34*a* defined by the first portion 32*a* of the housing 32 to provide a point of electrical connection between the speaker 56 and an electronic device contained within the respirator system 100 that does not obstruct the portion of the flow path defined by the second internal channel 34*b*. To this end, the housing 32 further includes a third channel 34*c* extending from the secondary chamber 50 to the first internal channel 34*a* through which electrical wires 72, 74 extend. In other embodiments, the speaker 56 may be operably connected to an electronic device by way of a wireless connection, such as Bluetooth® pairing. (Bluetooth® is a registered trademark of Bluetooth Sig, Inc. of Kirkland, Wash.)

One of ordinary skill in the art will recognize that additional embodiments are also possible without departing from the teachings of the present invention. This detailed description, and particularly the specific details of the exemplary embodiments and implementations disclosed therein, is given primarily for clarity of understanding, and no unnecessary limitations are to be understood therefrom, for modifications will become obvious to those skilled in the art upon reading this disclosure and may be made without departing from the spirit or scope of the invention.

What is claimed is:

1. An adapter for connecting a breathing tube to a headpiece, comprising:

a housing, including a first portion configured to connect to the breathing tube, a second portion configured to connect to the headpiece, and a hollow cavity extending through the first portion and the second portion to define a flow path for breathable air received from the breathing tube to travel through the adapter for delivery to the headpiece; and a speaker positioned within the housing and configured to emit an audible sound into the flow path.

2. The adapter of claim 1, wherein the speaker is positioned outside of the flow path.

3. The adapter of claim 1, wherein the flow path is non-linear.

4. An adapter for connecting a breathing tube to a headpiece, comprising:

a housing, including a first portion that is configured to connect to the breathing tube and defines a first internal channel having an inlet for receiving breathable air into the adapter, and a second portion that is configured to connect to the headpiece and defines a second internal channel having an outlet for emitting breathable air from the adapter, wherein the first internal channel and the second internal channel collectively define a flow path for breathable air to enter into and travel through the adapter; and a speaker positioned within the housing and configured to emit an audible sound into the flow path.

5. The adapter of claim 4, wherein the speaker is positioned outside of the flow path and opposite the outlet.

6. The adapter of claim 4, wherein the housing further includes a secondary chamber positioned outside the flow path, and the speaker is positioned in the secondary chamber.

7. The adapter of claim 6, wherein the housing further includes an internal wall that separates the secondary chamber from the flow path.

8. The adapter of claim 7, wherein the internal wall defines a port extending from the secondary chamber to the second internal channel.

9. The adapter of claim 8, wherein the port is positioned opposite the outlet.

10. The adapter of claim 6, wherein the secondary chamber is sealed with a potting material.

11. The adapter of claim 10, wherein the potting material defines a portion of an outer surface of the housing.

12. The adapter of claim 4, wherein the first internal channel and the second internal channel are angled relation to one another.

13. The adapter of claim 4, wherein the speaker includes one or more electrical wires extending from the speaker into the first internal channel.

14. An adapter for connecting a breathing tube to a headpiece, comprising:

a housing, including a first portion that is configured to connect to the breathing tube and defines a first internal channel having an inlet for receiving breathable air into the adapter, a second portion that is configured to connect to the headpiece and defines a second internal channel having an outlet for emitting breathable air from the adapter, wherein the first internal channel and the second internal channel collectively define a flow path for breathable air to enter into and travel through the adapter, and a secondary chamber positioned outside the flow path; and a speaker positioned in the secondary chamber and configured to emit an audible sound into the flow path.

15. The adapter of claim 14, wherein the secondary chamber is positioned opposite the outlet.

16. The adapter of claim 14, wherein the housing further includes a port defined by an internal wall, the port extending from the secondary chamber to the flow path.

17. The adapter of claim 16, wherein the port is positioned opposite the outlet.

18. The adapter of claim 14, wherein the housing further includes a third channel extending from the secondary chamber to the first internal channel, and wherein the speaker includes one or more electrical wires extending through the third channel.

* * * * *